US006851133B1

(12) United States Patent
Nehring

(10) Patent No.: US 6,851,133 B1
(45) Date of Patent: Feb. 8, 2005

(54) MOLD RESISTANT SHOWER ENCLOSURE

(76) Inventor: Walter Wayne Nehring, 15802 Panorama Ct., Del Valle, TX (US) 78617

( * ) Notice: Subject to any disclaimer, the term of this patent is extended or adjusted under 35 U.S.C. 154(b) by 0 days.

(21) Appl. No.: 10/316,465

(22) Filed: Dec. 11, 2002

(51) Int. Cl.[7] ..... A47K 3/40
(52) U.S. Cl. ..... 4/613; 4/612; 52/302.6
(58) Field of Search ..... 4/612, 613; 52/302.6

(56) References Cited

U.S. PATENT DOCUMENTS

| | | | | |
|---|---|---|---|---|
| 3,827,086 | A | | 8/1974 | Seymour et al. |
| 4,299,064 | A | | 11/1981 | Daniels |
| 4,384,377 | A | | 5/1983 | Calvert et al. |
| 4,428,085 | A | | 1/1984 | Bateson |
| 4,541,132 | A | * | 9/1985 | Long ..... 4/613 X |
| 4,571,026 | A | | 2/1986 | Maruta |
| 4,837,997 | A | | 6/1989 | Zeilinger |
| 4,916,764 | A | | 4/1990 | Meaden et al. |
| 5,073,996 | A | | 12/1991 | Schinle |
| D323,208 | S | | 1/1992 | Gunther |
| 5,159,723 | A | | 11/1992 | Benedict |
| 5,203,640 | A | | 4/1993 | Pourtau et al. |
| 5,435,021 | A | | 7/1995 | Williams |
| 5,705,002 | A | | 1/1998 | Sherry |
| 6,138,295 | A | | 10/2000 | Hess |
| 2002/0124306 | A1 | | 9/2002 | Smale |

* cited by examiner

*Primary Examiner*—Robert M. Fetsuga
(74) *Attorney, Agent, or Firm*—Larry Mason Lee

(57) ABSTRACT

A method of constructing shower enclosures which decreases the probability of mold growth by utilizing interior and/or exterior corner directional flow flashings between the joints of the sheets of synthetic marble or other non-porous material which cover the interior of the shower enclosure and the material comprising the vertical walls of the shower enclosure, a shower pan floor sloped downwardly toward the shower drain, a shower floor supported above the shower pan floor by spacers or mortar piers creating a void for air circulation between the shower floor and the shower pan floor, spacing between the shower floor periphery and the vertical walls of the shower pan to provide additional air circulation between the shower floor and the shower pan floor, shower enclosure horizontal framing members that are sloped toward the shower drain, shower enclosure horizontal framing members that are covered by the shower pan, a void, to increase air circulation, between the top of the shower pan vertical walls and air space between the framing members of the sheetrock used to enclose the shower stall, and a weep line positioned between the shower pan floor and the shower floor to permit insertion of mold inhibiting chemicals. Also disclosed is the shower enclosure so constructed.

8 Claims, 4 Drawing Sheets

MOLD RESISTANT SHOWER ENCLOSURE

BACKGROUND OF THE INVENTION a. Field of the Invention

The present invention is related generally to the field of methods of constructing mold resistant shower enclosures. Growth of molds in and about shower enclosures been identified as a substantial health problem in certain parts of the country. Growth of molds in and about shower enclosures can be substantially eliminated by use of the instant inventive method of constructing the shower enclosure.

The instant inventive method requires the use of several novel shower enclosure features and apparatus, each of which contributes to the reduction of moisture leakage and accumulation in and around the shower enclosure thereby reducing the potential for mold growth.

Accordingly, and more particularly, the instant invention is related to shower enclosures that are constructed utilizing interior and/or exterior corner directional flow flashings.

Yet more particularly, the instant invention is related to shower enclosures that are constructed utilizing a shower pan floor sloped downwardly toward the shower drain.

Yet more particularly, the instant invention is related to shower enclosures that are constructed such that the shower floor is supported above the shower pan floor creating a void for air circulation and water drainage between the shower floor and the shower pan floor.

Yet more particularly, the instant invention is related to shower enclosures that are constructed such that spacing exists between the shower floor periphery and the vertical walls of the shower pan.

Yet more particularly, the instant invention is related to shower enclosures that are constructed such that horizontal members framing the shower enclosure are sloped toward the shower drain.

Yet more particularly, the instant invention is related to shower enclosures that are constructed such that horizontal members framing the shower enclosure are covered by the shower pan.

Yet more particularly, the instant invention is related to shower enclosures that are constructed such that a void, for ventilation, is created between the top of the shower pan vertical walls and the bottom of the sheetrock used to enclose the shower stall.

Even yet more particularly, the instant invention is related to shower enclosures that are constructed with a weep line positioned between the shower pan floor and the shower floor to permit insertion of mold inhibiting chemicals.

b. Description of the Prior Art

There are numerous shower enclosure designs in common usage. Certain of the individual features of the instant invention are well known. Other individual features of the instant invention are subject to the on sale bar. However, no shower enclosure design or method of construction encompasses or embodies all of the features of the instant invention or encompasses the use of such features as hereinafter disclosed.

Accordingly, the prior art relevant to the instant invention is known to applicant to include the following features:

It is known in the prior art to construct a shower enclosure to support a shower pan providing a shower pan floor which slopes toward a drain.

It is known in the prior art to construct a shower enclosure having a shower floor which rests upon a mortar bed on top of the shower pan floor where the shower pan floor is sloped toward the drain strainer receiver which provides weep holes for the flow of moisture into the shower drain.

It is known in the prior art to construct a shower enclosure whose horizontal members are coated or treated with waterproof material to prevent moisture from penetrating into such members and thereby serving as a growth medium for mold.

It is known in the prior art to construct a shower enclosure which utilizes flashings to back corners of the finished shower to prevent moisture seepage into the shower enclosures supporting members.

It is known in the prior art to construct a shower enclosure which provides for spacing between the shower pan floor and the shower floor.

It is known in the prior art to construct a shower enclosure which incorporates any or all of the above-stated well-known prior art features.

It is, finally, well-known and understood that the accumulation of moisture in and around a shower enclosure will provide a medium for the growth of mold and that mold is potentially harmful to the health of the inhabitants of that building, home, or structure in which the shower enclosure is constructed.

Accordingly, it is seen that the prior art of constructing shower enclosures is deficient in that mold growth is common in and around current, state of the art shower enclosures.

SUMMARY OF THE INVENTION

The instant invention is of a method of constructing a shower enclosure, and of the shower enclosure so constructed, which incorporates certain novel features to reduce the leakage or accumulation of moisture and thereby reduces the probability of mold growth.

The usual method of constructing a shower enclosure is to begin by fastening into position certain vertical and horizontal members, commonly referred to as framing members, to support the shower pan and create the framework or outline of the shower being constructed above the drain. The drain is typically a through the foundation pipe connecting the shower to the building structure's plumbing drainage. Usually, following construction of the framing of a shower enclosure, a shower pan is then installed into the shower enclosure. It is also known to position the framing members after placement of the shower pan over the drain. A shower pan will, at a minimum, provide a shower pan floor and shower pan vertical walls. Such vertical walls may, in the current state of the art be merely a matter of inches in height, or may extend the entire height of the vertical wall of the finished shower.

Continuing description of the usual method, after the shower pan is installed, sheetrock is commonly attached to the shower enclosure framing members to create a shower enclosure. Window frames are also commonly attached to the shower enclosure framing members in lieu of sheetrock in order to create currently fashionable "garden showers." After the enclosure is defined by the installation of sheetrock and/or window frames, sheets of synthetic marble or other non-porous material are placed upon a mortar bed on top of the floor of the shower pan and adhered to the interior of the vertical walls of the shower enclosure. A shower door is then installed by sealed connection to the framing members to provide for ingress and egress to the shower enclosure. Grout or one of several shower enclosure sealant materials, commonly silicon glue compounds, are then used to fill the spaces between the sheets of synthetic marble or other non-porous material on the vertical portions of the shower enclosure and between the sheet of synthetic marble or other non-porous material forming the shower floor and the drain strainer in order to attempt to create an enclosure which is watertight excepting water flow out the drain.

The primary problem in the prior art addressed by the instant invention is that of directing the flow of moisture in and around a shower enclosure into and toward the shower drain such that moisture is not permitted to accumulate and serve as a medium for the growth of mold. The instant invention improves substantially upon the above-described common method of constructing a shower. Each of the instant invention's improvements is calculated to prevent moisture leakage from the shower into the surrounding shower enclosure framing members, to reduce moisture accumulation in and around the shower enclosure, or to provide means to kill such mold as does grow.

Accordingly, it is an object of the instant invention to provide a method of constricting shower enclosures utilizing interior and/or exterior corner directional flow flashings between the sheets of synthetic marble or other non-porous material comprising the vertical walls of the interior of the shower enclosure.

It is another object of the instant invention to provide a method of constructing shower enclosures utilizing a shower pan floor sloped downwardly toward the shower drain.

It is yet another object of the instant invention to provide a method of constructing shower enclosures that utilizes a shower floor supported above the shower pan floor creating a void for air circulation and water drainage between the shower floor and the shower pan floor.

It is yet another object of the instant invention to provide a method of constructing shower enclosures that inserts spacing between the shower floor periphery and the vertical walls of the shower pan.

It is yet another object of the instant invention to provide a method of constructing shower enclosures such that horizontal members framing the shower enclosure are sloped toward the shower drain.

It is yet another object of the instant invention to provide a method of constructing shower enclosures such that horizontal members framing the shower enclosure are covered by the shower pan.

It is yet another object of the instant invention to provide a method of constructing shower enclosures such that a void, for ventilation is created between the top of the shower pan vertical walls and the bottom of the sheetrock used to enclose the shower stall.

It is yet another and final object of the instant invention to provide a method of constricting shower enclosures with a weep line positioned between the shower pan floor and the shower floor to permit insertion of mold inhibiting chemicals.

DESCRIPTION OF NUMERIC REFERENCES

10. Interior corner directional flow flashing
11. not used
12. Drain strainer receiver
13. Drain strainer
14. Floor of shower pan
15. Working surface of left panel of interior corner directional flow flashing
16. Top edge of left panel of interior corner directional flow flashing
17. Outer edge of left panel of interior corner directional flow flashing
18. Bottom edge of left panel of interior corner directional flaow flashing
19. not used
20. Working surface of right panel of interior corner directional flow flashing
21. Top edge of right panel of interior corner directional flow flashing
22. Outer edge of right panel of interior corner directional flow flashing
23. Bottom edge of right panel of interior corner directional flow flashing
24. Center fold of interior corner directional flow flashing
25. Left hand upper-most directional vane, ribbing, scoring or etching on interior corner directional flow flashing
26. Left hand second upper-most directional vane, ribbing, scoring or etching on interior corner directional flow flashing
27. Left hand third upper-most directional vane, ribbing, scoring or etching on interior corner directional flow flashing
28. Left hand fourth upper-most directional vane, ribbing, scoring or etching on interior corner directional flow flashing
29. Right hand upper-most directional vane, ribbing, scoring or etching on interior corner directional flow flashing
30. Right hand second upper-most directional vane, ribbing, scoring or etching on interior corner directional flow flashing
31. Right hand third upper-most directional vane, ribbing, scoring or etching on interior corner directional flow flashing
32. not used
33. not used
34. not used
35. Interior of left hand wall of shower pan
36. Interior of right hand wall of shower pan
37. Top surface of left hand wall of shower pan
38. Top surface of right hand wall of shower pan
39. not used
40. Exterior corner directional flow flashing
41. Outer edge of right panel of exterior corner directional flow flashing
42. Outer edge of left panel of exterior corner directional flow flashing
43. Right hand directional vane, ribbing scoring or etching on exterior corner directional flow flashing
44. Second right hand directional vane, ribbing, scoring or etching on exterior corner directional flow flashing
45. Center fold of exterior corner directional flow flashing
46. Left hand directional vane, ribbing, scoring or etching on exterior corner directional flow flashing
47. Second left hand directional vane, ribbing, scoring or etching on exterior corner directional flow flashing
48. not used
49. not used
50. First sheet of sheetrock wall material
51. not used
52. not used
53. not used
54. Fifth sheet of sheetrock wall material
55. Second sheet of sheetrock wall material
56. Third sheet of sheetrock wall material
57. First nail in third sheet of sheetrock wall material
58. Second nail in third sheet of sheetrock wall material
59. Third nail in third sheet of sheetrock wall material
60. Vertical shower pan surface
61 Sloped shower pan surface over second horizontal framing member

62. First vertical wall of shower pan
63. First horizontal framing member
64. Second vertical wall of shower pan
65. Airway
66. Vertical framing member
67. Second horizontal framing member
68. Sloped shower pan surface over first horizontal framing member
69. Second vertical framing member
70. Fourth sheet of sheetrock material
71. Third vertical framing member
72. Fourth vertical framing member
73. First nail in fourth sheet of sheetrock material
74. Second nail in fourth sheet of sheetrock material
75. Third nail in fourth sheet of sheetrock material
76. Fourth nail in fourth sheet of sheetrock material
77. Fifth nail in fourth sheet of sheetrock material
78. Sixth nail in fourth sheet of sheetrock material
79. not used
80. Fifth vertical framing member
81. not used
82. Sloped mortar bed
83. Third vertical wall of shower pan
84. Third horizontal framing member
85. Sloped shower pan surface over third horizontal framing member
86. Space between shower floor and drain strainer
87. not used
88. not used
89. not used
90. Sloped shower pan floor
91. Mortar piers
92. Void
93. Space between periphery of shower floor and vertical sidewalls of shower pan 94. sheet of non-porous material
95. Building foundation
96. Drain pipe connector
97. Drain pipe
98. not used
99. not used
100. Weep line
101. First aperture in weep line
102 Second aperture in weep line
103 Third aperture in weep line

BRIEF DESCRIPTION OF THE DRAWINGS

While the novel features of the instant invention are set forth with particularity in the appended claims, a full and complete understanding of the invention can be had by referring to the detailed description of the preferred embodiment which is set forth subsequently, and which is as illustrated in the accompanying drawings, in which.

DESCRIPTION OF THE PREFERRED EMBODIMENT(S)

Figure 2:
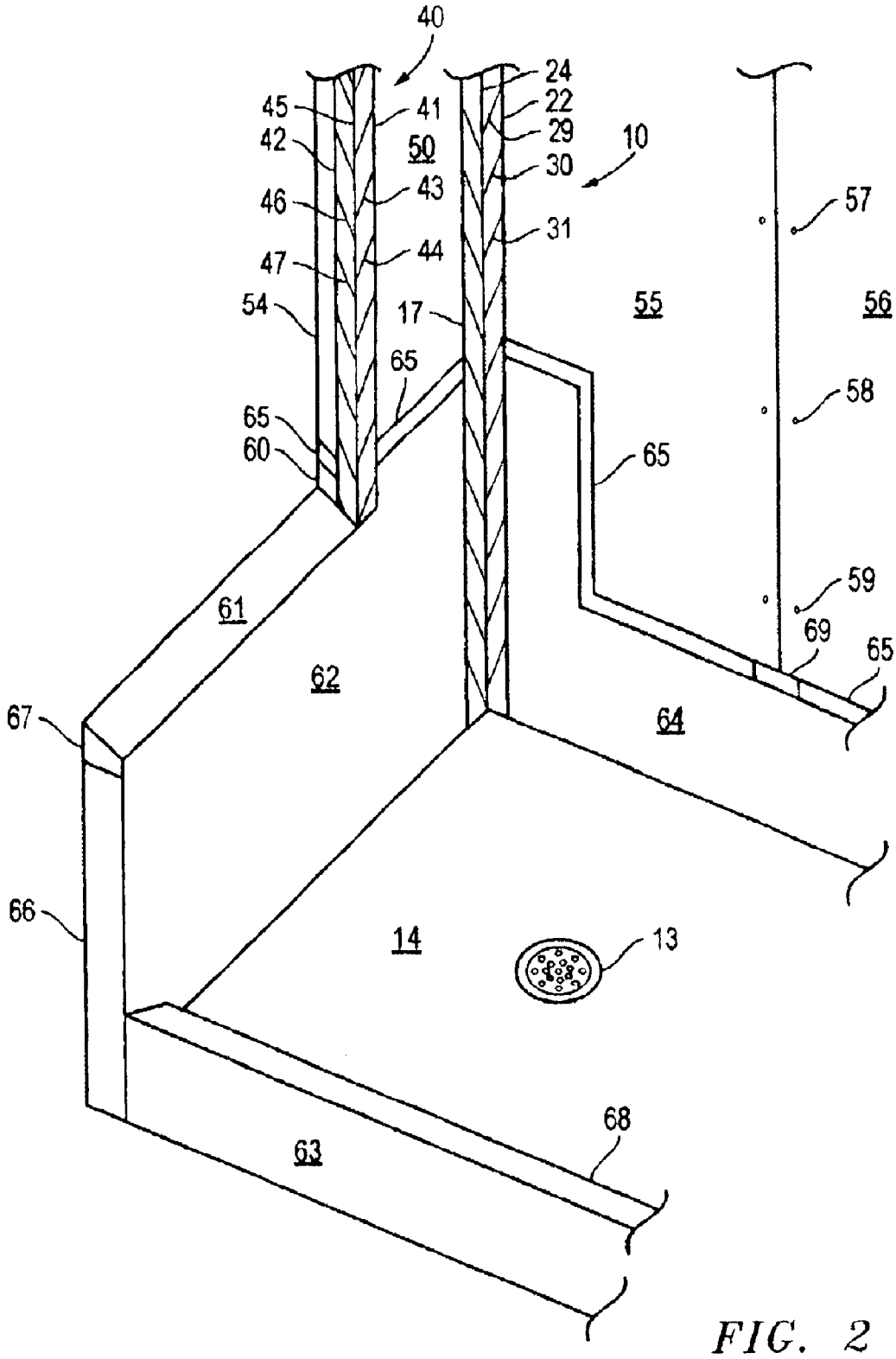
FIG. 2 is a perspective view of a cut-away portion of the shower enclosure of the instant invention without the sheets of synthetic marble or other non-porous material covering the interior of the shower enclosure installed.

The instant invention is of a method of constructing a shower enclosure and of the shower enclosure so constructed, the most complete view of which is available as FIG. 2. The shower enclosure of the instant invention incorporates certain novel features to reduce the leakage out of or accumulation of moisture in and around the shower and thereby reduces the probability of mold growth. As shown in FIG. 2, a shower enclosure is constructed by fastening into position what is commonly and hereinafter referred to as framing members comprising certain vertical members 66 and 69 and certain horizontal members 67, and 63, together with additional horizontal and vertical members not shown in FIG. 2 because they are behind either the shower pan 14, 61, 62, 64, and 68 or the sheetrock 50, 54, 55, and 56. The purpose of fastening together the framing members, which are commonly comprised of cut lumber, is to support the shower pan 14, 61, 62 64, and 68 and create the framework or outline of the shower being constructed above the drain, the drain strainer 13 being depicted centrally to the shower pan floor 14 in FIG. 2. The drain, depicted in greater detail in FIG. 3, typically comprises a through the foundation 95 drain pipe 97 connecting the shower to the building structure's plumbing drainage. The components of the drain are a drain pipe 97, a drain pipe connector 96, a drain strainer receiver 12, and a drain strainer 13. Referring back to FIG. 2, usually the next step following fastening together of the framing members of the shower enclosure, a shower pan 14, 61, 62, 64, and 68 is then installed into the shower enclosure. Alternatively, the framing members may be positioned and fastened together after placement of the shower pan 14, 61, 62, 64, and 68 over the drain pipe 97 after installation of the drain pipe connector 96 and the creation of a sloped mortar bed 82, depicted in FIG. 3. A shower pan 14, 61, 62, 64, and 68 (including elements 61 and 85 in the configuration of FIG. 3) will, at a minimum, provide a shower pan floor 14 and shower pan vertical walls 62 and 64. Such shower pan vertical walls 62 and 64 may, in the current state of the art be merely a matter of inches in height, or may extend the entire height of the vertical wall of the finished shower.

Figure 3:
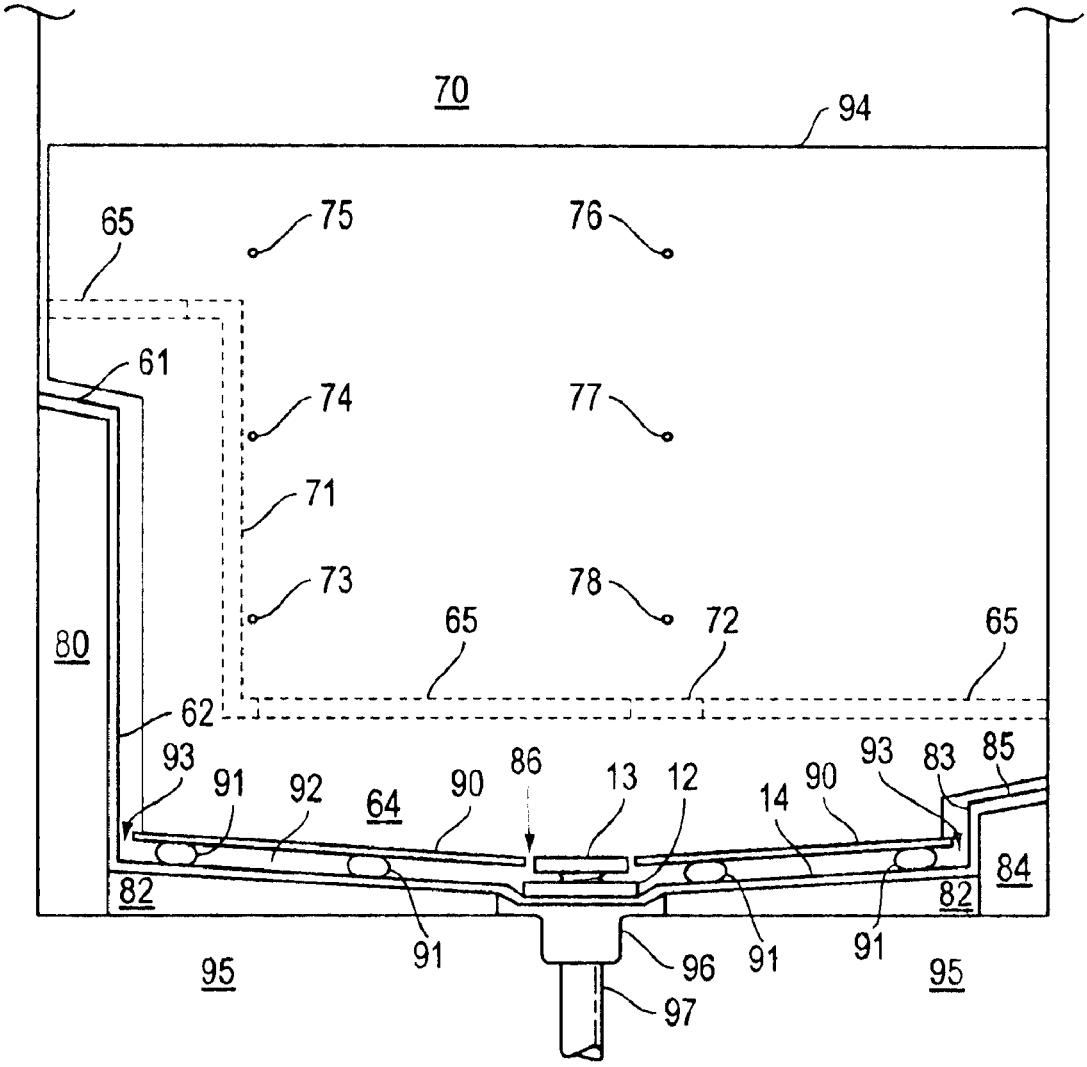
FIG. 3 is a vertical plane view of the shower enclosure of the instant invention without the sheets of synthetic marble or other non-porous material covering the interior of the shower enclosure installed.

After the shower pan 14, 61, 62, 64, and 68, as depicted in FIG. 2, is installed, sheetrock 50, 54, 55, and 56 is commonly attached to the shower enclosure framing members to create a shower enclosure. Window frames, not depicted, are also commonly attached to the shower enclosure framing members in lieu of sheetrock 50, 54, 55, and 56 in order to create currently fashionable "garden showers."After the enclosure is defined by the installation of sheetrock 50, 54, 55, and 56 and/or window frames, not depicted, the sheets of synthetic marble or other non-porous material 94, a single vertical sheet of which is depicted in FIG. 3 only, together with the non-porous material comprising the shower floor 90, depicted in FIG. 3 only, which together provide covering for the interior of the shower enclosure are placed upon a mortar bed on top of the shower pan floor 14 and adhered to the interior of the vertical walls of the shower enclosure. A shower door, not depicted, is then installed by scaled connection to the framing members to provide for ingress and egress to the shower enclosure. Grout or one of several shower enclosure sealant materials, commonly silicon glue compounds, are then used to fill the spaces between the vertical sheets of synthetic marble or other non-porous material 94 comprising interior walls of the shower enclosure and the shower floor 90, and between the synthetic marble or other nonporous material comprising the shower floor 90 and the drain strainer 13 in order to attempt to create a watertight enclosure.

The primary problem in the prior art addressed by the instant invention is that of directing the flow of moisture in and around a shower enclosure into and toward the shower drain such that moisture is not permitted to accumulate and serve as a medium for the growth of mold. The instant invention improves substantially upon the above-described common method of constructing a shower enclosure. Each of the instant invention's improvements is calculated to prevent moisture leakage from the shower into the surrounding shower enclosure framing members, to reduce moisture accumulation in and around the shower enclosure, or to provide means to kill such mold as does grow.

Figure 1:
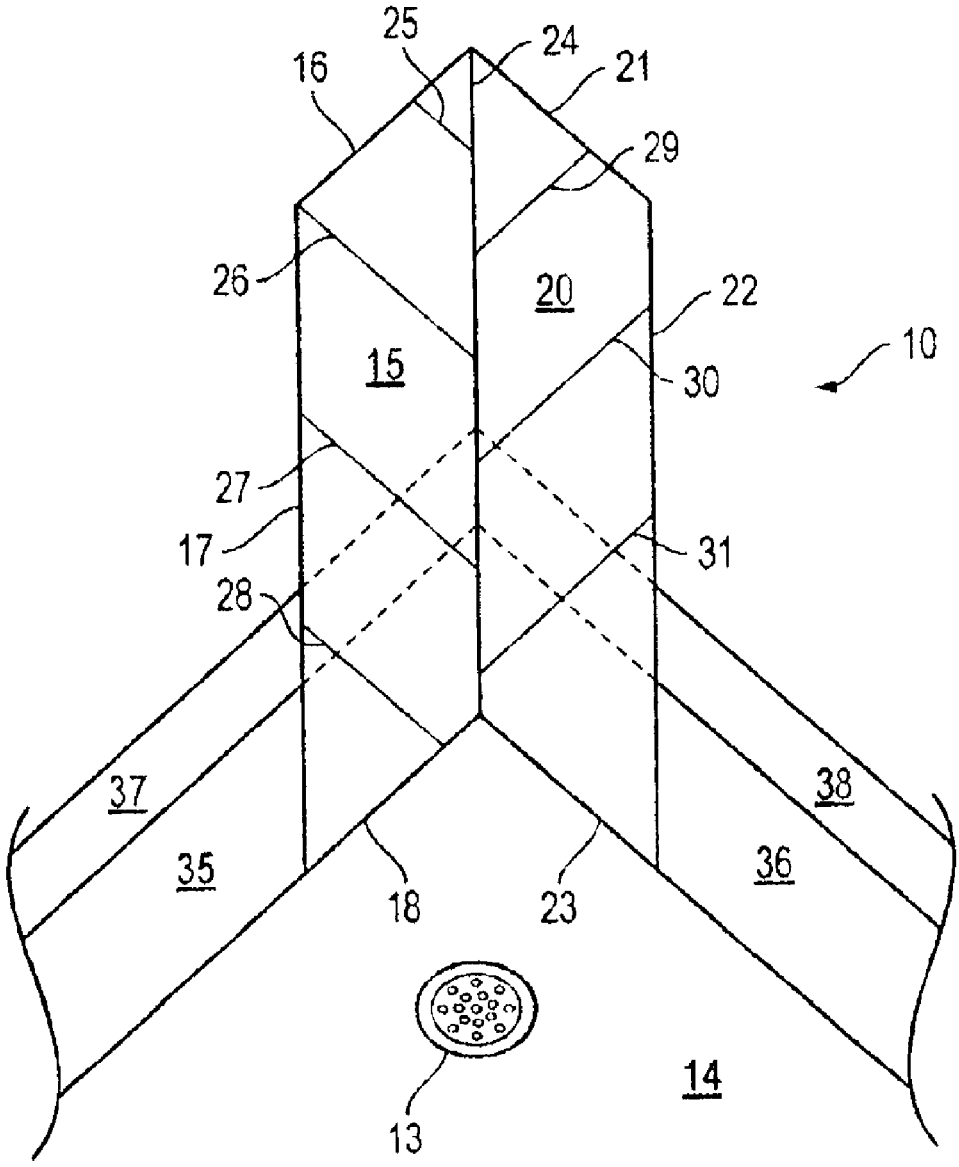
FIG. 1 is a perspective view of the interior corner directional flow flashing of the instant invention positioned vertically in the corner of a shower pan.

The first improvement to the method and art of constructing shower enclosures is the use of interior corner directional flow flashings 10, depicted in FIGS. 1 and 2, and exterior corner directional flow flashings 40, depicted in FIG. 2.

As seen in FIG. 1, the interior corner directional flow flashing 10 comprises a left hand working surface 15 and a right hand working surface 20. The interior corner directional flow flashing 10 is installed in the shower enclosure such that each working surface 15 and 20 is facing the interior of the shower enclosure, toward the drain strainer 13. Further, as depicted in both FIGS. 1 and 2, the interior corner directional flow flashing 10 is installed in the shower enclosure such the bottom of the interior corner directional flow flashing 10 is located within the shower pan 14, 61, 62, 64, and 68. Each of the working surfaces 15 and 20 provides directional vanes, ribbing, scoring or etchings; 25, 26, 27, and 28 on the left hand working surface 15, and 29 30, and 31 on the right hand working surface 20.

In FIG. 1, the flashing 10 of the instant invention is of a single piece construction, metal or plastic, with a center fold line 24, whereby two interior surface panels 15 and 20 are discernable. While no specific angle exists between the two working surface panels 15 and 20, where the flashing 10 is standing vertically in a corner of a shower enclosure such angle approximates 90°. In FIG. 1, the center fold line 24 is depicted as a crisp line approximately midway between the left vertical edge 17 and the right vertical edge 22 of the interior corner directional flow flashing 10. No such limitation exists in the invention as the directional vanes, ribbing, scoring or etchings 25, 26, 27, 28, 29, 30, and 31 on the working surfaces, 15 and 20, of the interior corner directional flow flashing 10 will effectively direct the flow of accumulated moisture even if the interior corner directional flow flashing 10 is semi-circular, in which case no center fold line 24 would exist. The novelty of such interior corner directional flow flashing 10 being the placement of the directional vanes, ribbing, scoring or etchings 25, 26, 27, 28, 29, 30, and 31 on the working surface or surfaces 15 and 20 of the interior corner directional flow flashing 10 such that the flow of accumulated moisture on such working surface or surfaces 15 and 20 is directed inwardly toward the interior of the interior corner directional flow flashing 10 and toward a moisture discharge point or points rather than toward the left vertical edge 17 and the right vertical edge 22 of the interior corner directional flow flashing 10. Where the moisture discharge points of the interior corner directional flow flashing 10, as depicted in FIG. 1, is along the bottom edges 18 and 23 of the interior corner directional flow flashing 10 so that accumulated moisture on the working surfaces 15 and 20 will flout toward the center line 24 of the interior corner directional flow flashing 10, down the center line 24 to the bottom edges 18 and 23 which rest on the shower pan floor 14, inside of the shower pan 14, 35, 36, 37, and 38, as configured and depicted in FIG. 1, and subsequently flow down the sloped shower pan floor 14, through weepholes in the drain strainer receiver 12, and down the drain pipe 97, see FIG. 3, and not into the surrounding building structure.

The value of the directional vanes, ribbing, scoring or etchings 25, 26, 27, 28, 29, 30, and 31 is readily understood when it is considered that when placed in the vertical position the interior corner directional flow flashing 10, as depicted in FIG. 1, may be considered as simply two flat panels joined at the center fold line 24. The natural action of accumulated moisture on a flat vertical panel is to form rivulets or streams flowing downwardly, but randomly taking direction to the right or left. The random change of direction of the rivulets of accumulated moisture to the tight or left is, in the absence of the application of external forces, controlled by the random occurrence of imperfections in the surface of the flat vertical panel. The directional vanes, ribbing, scoring or etchings 25, 26, 27, 28, 29, 30 and 31 may be considered as non-random, intentionally created imperfections in the surface of the flat vertical panel. Thus, accumulated moisture flow is intentionally directed toward a discharge point or points on the interior corner directional flow flashing 10 by the directional vanes, ribbing, scoring or etchings 25, 26, 27, 28, 29, 30, and 31 on the working surfaces 15 and 20.

In FIG. 2, an exterior corner directional flow flashing 40 is depicted. The exterior corner directional flow flashing 40 is depicted as providing a center fold line 45, a left hand vertical edge 42, a right hand vertical edge 41, and directional vanes, ribbing, scoring or etchings 46, 47, 43, and 44, together with other depicted but un-numbered directional vanes, ribbing, scoring or etchings on its working surfaces. Operation of the exterior corner directional flow flashing 40 is as previously described for the interior corner directional flow flashing 10, excepting that the moisture discharge points for the exterior corner directional flow flashing 40 are along its bottom edge which rests upon the sloped horizontal wall 61 and the vertical wall 62 of the shower pan 14, 61, 62, 64, and 68, as configured and depicted in FIG. 2, whereby the moisture discharges into the shower pan 14, 61, 62, 64, and 68.

Also, as can be seen by examination of FIG. 2, the directed flow flashings, 10 and 40, of the instant invention are installed in the shower enclosure such that their moisture-discharge points are within the shower pan 14, 61, 62, 64, and 68, and such that the directed flow flashings, 10 and 40, are between the sheetrock 54, 50, 55, and 56, forming the vertical walls of the shower enclosure and the sheets of synthetic marble or other non-porous material, see 94 on FIG. 3, which would be installed on the interior of the vertical walls of the shower enclosure. The directional flow flashings, 10 and 40, when installed vertically, should be installed so that either their working surfaces, 15 and 20 and un-numbered on the external corner directional flow flashing 40, or the ribs 26, 27, 28, 29, 30, 31, 43, 44, 46, 47, and other un-numbered as depicted in FIG. 2, contact the back side of the sheer of nonporous material 94.

The function of the sheetrock 54, 50, 55, and 56, is to provide adhesive backing for and spacing between the back side of the sheets of synthetic marble or other non-porous material used to line the interior of the shower enclosure and the framing members 61, 63, 66, 67 and 69 or shower pan vertical walls 60, 62, and 64. Accordingly, the instant invention may be practiced with spacers, not depicted, rather than sheetrock.

The second improvement to the method and art of constructing shower enclosures is the use of spacers or mortar piers 91, instead of a mortar bed, between the shower floor 90 and the shower pan floor 14, depicted in FIG. 3, which is sloped downwardly toward the shower strainer receiver 12, such that the flow or water into the weepholes of the drain strainer receiver 12 is not impeded. The spacers or mortar piers 91 have been depicted in FIG. 3 schematically as perfect ovals, however the spacers or mortar piers 91 are typically simply blobs of mortar applied manually, and no particular shape of such spacers or mortar piers 91 is intended to be a part of the invention disclosed hereby. The use of the mortar piers 91 or spacers creates a void between the shower floor 90 and the shower pan floor 14 which improves water flow and increases air circulation and thus moisture drying between the shower floor 90 and the shower pan floor 14. The shower floor 90 is typically comprised of a horizontal sheet of synthetic marble or other non-porous material placed on mortar piers 91 or spacers which rest on the upper surface of the shower pan floor 14. Accordingly, the slope or the shower pan floor 14 closely follows the slope of the shower floor 90. The shower pan floor 14 is typically the bottom portion of a pre-formed fiberglass, plastic or similar material, shower pan 14, 61, 62, 64, and 58, as configured and depicted in FIG. 2, and 14, 61, 62, 64, and 85 as configured and depicted in FIG. 3, which is supported above the building or structure floor by a sloped mortar bed 82. The sloped mortar bed 82 is usually formed to provide even support to all of the shower pan floor 14, and thus the sloped mortar bed 82 is also sloped toward the shower drain. Necessarily, the drain strainer receiver 12 provides apertures through which moisture can enter the drain pipe 97 and be discharged from the shower enclosure.

The sloped shower floor 90 of the instant invention, as depicted in FIG. 3, provides for spacing 93 around its periphery between the sheet of synthetic marble or other non-porous material comprising the shower floor 90 and the shower pan vertical walls 62 and 83. Additionally, the sheet of synthetic marble or other non-porous material comprising the shower floor 90 is supported above the shower pan floor 14 by mortar piers 91 or spacers. By placing the sheet of synthetic marble or other non-porous material comprising the shower floor 90 on mortar piers 91 or spacers, a void 92 is created between the shower pan floor 14×and the shower floor 90. The void 92, in conjunction with the spacing 93 serves to define an airway, a ventilation path, between the shower pan floor 14 and the shower floor 90. This airway or ventilation path serves to permit air circulation within and final drying of the spacing, the void 92, between the shower pan floor 14 and the shower floor 90. The sheet of synthetic marble or other non-porous material comprising the shower floor 90 depicted in FIG. 3 are adhered to the tops of the mortar piers 91 or spacers which provide spacing from the shower pan floor 14 and thereby create the void 92.

The third improvement to the method and art of constructing shower enclosures is the use of sloped horizontal surfaces on the members that frame the shower enclosure. For example, in FIG. 2 the horizontal member 67 provides a sloped upper surface and the horizontal member 63 which forms the threshold or step into the shower enclosure provides a sloped upper surface, in FIG. 3, which is a different configuration shower enclosure than that depicted in FIG. 2, the vertical member 80 provides a sloped upper surface and the horizontal member 84, with is the threshold or step in the configuration of FIG. 3, provides a sloped upper surface. All sloped upper surfaces slope toward the shower drain. It is common that the upper surfaces of members used to frame the shower enclosure will be coated with fiberglass or other water repellant material in order to keep moisture from seeping into the member and providing a nutrient source for mold growth. However, such common coating of the member surfaces is not completely effective as the moisture pools on top of the water repellant material and mold tends to grow on top of the member surface being so protected. The instant invention avoids this source of mold growth by deliberately sloping the tops of the member surfaces toward the shower drain so that moisture accumulation will run off the member and either evaporate or be discharged through the shower drain from the shower enclosure.

The fourth improvement to the method and art of constructing shower enclosures is that the shape of the shower pan 14, 61, 62, 64, and 68, as configured and depicted in FIGS. 2, and 14, 61, 62, 64, and 85 as configured and depicted in FIG. 3, is such that all horizontal surfaces created by the shower enclosure framing members are covered with sloped surfaces' 61, 68, and 85, of the shower pan 14, 61, 62, 64, and 68, as configured and depicted in FIGS. 2, and 14, 61, 62, 64, and 85 as configured and depicted in FIG. 3, which are sloped toward the shower drain. Commonly, shower pans are either simple box-like constructs providing a floor and four vertical walls, or are elaborate pre-fabricated units defining then entirety of the shower enclosure. There is a growing trend toward hand-laying fiberglass to form a shower pan. This is necessitated by the trend toward design of custom shower enclosures. The novelty of the instant shower pan 14, 61, 62, 64, and 68, as configured and depicted in FIGS. 2, and 14, 61, 62, 64, and 85 as configured and depicted in FIG. 3, is that it extends up to and over the sloped horizontal framing member surfaces, 61, 68, and 85, thereby preventing moisture accumulation on what would normally be horizontal surfaces and directing the accumulated moisture flow toward the shower drain.

The fifth improvement to the method and art of constructing shower enclosures is that a void 65, for ventilation, is created between the top of the shower pan vertical walls 62 and 64 and the bottom of the sheetrock 50, 55, 56, and 70 used to enclose the shower stall. This void 65 permits air circulation between the top of the shower pan 14, 61, 62, 64, and 68, as configured and depicted in FIG. 2, and 14, 61, 62, 64, and 85 as configured and depicted in FIG. 3, and the bottom of the sheetrock 50, 55, 56, and 70, and this air circulation dries the moisture which normally accumulates and nourishes mold growth along the line where the top of the shower pan 14, 61, 62, 64, and 68, as configured and depicted in FIG. 2, and 14, 61, 62, 64, and 85 as configured and depicted in FIG. 3, and the bottom of the sheetrock 50, 55, 56, and 70. In FIG. 2, the airway or void 65 is depicted, from left to right, as being above the shower pan vertical wall 60, below the sheetrock 54, continuing behind the exterior corner directional flow flashing 40, above the shower pan vertical wall 62 and below the sheetrock 50, continuing behind the interior corner directional flow flashing 10, above the shower pan vertical wall 64 and beneath the two panels of sheetrock 55 and 56. Reference numeral 69 depicts the presence of a shower enclosure vertical support member, and nail heads 57, 58, and 59, together with others un-numbered, indicate attachment means of the sheetrock 55 and 56 to the vertical member 69. In FIG. 3, the airway or void 65 is depicted, from left to right, as being above the shower pan vertical wall 64, below the sheetrock panel 70. Reference numerals 71 and 72 depict the presence of shower enclosure vertical support members, and nail heads 73, 74, 75, 76, 77, and 78 indicate attachment means of the sheetrock panel 70 to the vertical members 71 and 72.

Figure 4:
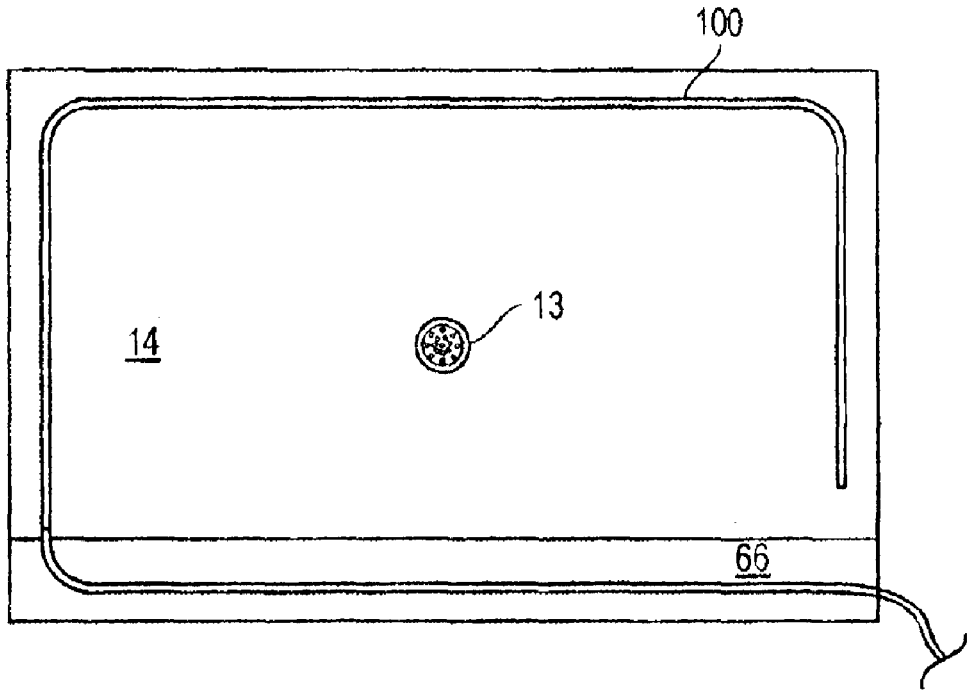
FIG. 4 is a horizontal plane view of the shower pan floor of the instant invention without the sheets of synthetic marble or other non-porous material covering the interior of the shower enclosure installed.
Figure 5:
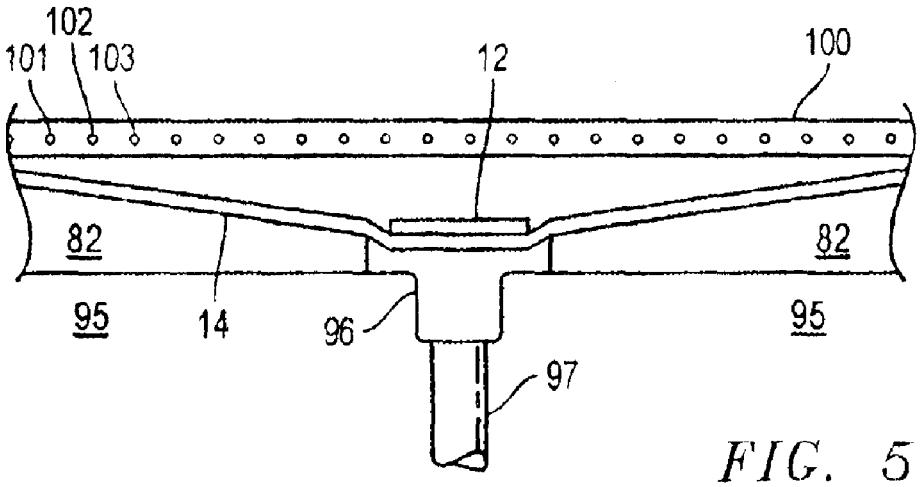
FIG. 5 is a vertical plane view of the shower pan floor of the instant invention without the sheets of synthetic marble or other non-porous material covering the interior of the shower enclosure installed.

The sixth improvement to the method and art of constructing shower enclosures is that a weep line 100, see FIGS. 4 and 5, is installed and positioned between the shower pan floor 14 and the shower floor 90 to permit injection and insertion of mold inhibiting chemicals into the airway or void 92. Commonly used mold inhibiting chemicals include household bleach. The weep line 100 depicted in FIGS. 4 and 5 is a flexible hose, closed on one end, which provides small apertures 101, 102, 103, and numerous other un-numbered, in its surface through which mold inhibiting chemicals injected in the weep line's 100 non-closed end can seep or weep out into the void 92. The shower pan floor 14 being sloped downwardly toward the shower drain, such mold inhibiting chemicals will serve to fully and finally kill any small pockets of mold as have begun growth, particularly in and around the drain strainer receiver 12 or the drain pipe connector 96, or the mortar piers 91 or spacers between the shower floor 90 and the shower pan floor 14.

While each of the above-described improvements to the method and art of constructing shower enclosures is independently important, the synergistic impact of all such improvements taken in unison is to create a shower enclosure where not only at the level of the sheets of synthetic marble or other non-porous material covering the interior of the shower enclosure, normally all that is seen by the shower user, but at the structural level, the level of the shower enclosure's structural members, all water and moisture accumulation is directed toward the shower's drain by horizontal surfaces that are sloped toward the drain and are covered by sloped horizontal surfaces 61, 68, and 85, of the shower pan 14, 61, 62, 64, and 68, as configured and depicted in FIG. 2, and 14, 61, 62, 64, and 85 as configured and depicted in FIG. 3.

The method of the instant invention is to construct a shower enclosure, as hereinabove previously and commonly described, which additionally incorporates one or more of the above-identified improvements, each of which will separately and independently have a salutary effect upon the inhibition of mold growth in and around the shower enclosure.

The product or device of the instant invention is a shower enclosure constructed to incorporate one or more of the above-identified improvements.

While the preferred embodiments of the instant invention have been described in substantial detail and fully and completely hereinabove, it will be apparent to one skilled in the art that numerous variations of the instant invention may be made without departing from the spirit and scope of the instant invention, and accordingly the instant invention is to be limited only by the following claims.

I claim:

1. A shower enclosure comprising:

a shower drain, framing members, a shower pan, a shower floor, a sloped mortar bed, spacers or mortar piers, and sheets of non-porous material;

wherein said sheets of non-porous material cover the interior of said shower enclosure, said sloped mortar bed is located between the foundation of the structure into which said shower enclosure is installed and said shower pan, said mortar piers are located between said shower pan and said shower floor, and said spacers are located between said framing members and said sheets of non-porous material; and wherein said shower enclosure additionally comprises one or more of:

(spacer materials between said framing members and said sheets of non-porous material creating a void above said shower pan into the air space between said framing members;

a directional flow flashing between said spacer materials and the joint of said sheets of non-porous material;

spacers to create a void for air circulation between said shower floor and said shower pan floor;

a space between said shower floor periphery and the walls of said shower pan;

spacers to create a void for air circulation between said shower floor and said shower pan floor, a space between said shower floor periphery and the walls of said shower pan, and a slope of said shower floor toward said shower drain;

a slope of said framing member's horizontal members toward said shower drain;

a coverage of said framing member's horizontal members by said shower pan;

a weep line positioned between said shower pan floor and said shower floor to permit injection of mold inhibiting chemicals.

2. The shower enclosure of claim 1 additionally comprising a directional flow flashing between said spacer materials and the joints of said sheets of non-porous material.

3. The shower enclosure of claim 1 additionally comprising a space between said shower floor periphery and the walls of said shower pan.

4. The shower enclosure of claim 1 additionally comprising a slope of said framing member's horizontal members toward said shower drain.

5. The shower enclosure of claim 1 additionally comprising a slope of said shower floor toward said shower drain.

6. The shower enclosure of claim 1 additionally comprising a coverage of said framing member's horizontal members by said shower pan.

7. The shower enclosure of claim 1 additionally comprising a weep line positioned between said shower pan floor and said shower floor to permit injection of mold inhibiting chemicals.

8. A method of constructing a shower enclosure wherein said shower enclosure comprises:

a shower drain, framing members, a shower pan, a shower floor, a sloped mortar bed, spacer or mortar piers, and sheets of non-porous material;

wherein said sheets of non-porous material cover the interior of said shower enclosure, said sloped mortar bed is located between the foundation of the structure into which said shower enclosure is installed and said shower pan, said mortar piers are located between said shower pan and said shower floor, and said spacers are located between said framing members and said sheets of non-porous material; and wherein said method includes one or more of the steps of:

(installing spacer materials between said framing members and said sheets of non-porous material creating a void above said shower pan into the air space between said framing members;

installing a directional flow flashing between said spacer materials and the joints of said sheets of non-porous material;

using spacers to create a void for air circulation between said shower floor and said shower pan floor;

placing said shower floor upon said mortar piers with spacing between said shower floor periphery and the walls of said shower pan;

placing said shower floor upon said shower pan floor with spacers to create a void for air circulation between said shower floor and said shower pan floor and with spacing between said shower floor periphery and the walls of said shower pan and with a slope to a said shower drain;

sloping the tops of said framing members toward said shower drain;

shaping said shower pan so that all horizontal surfaces of said framing members are covered by said shower pan;

creating a void between the top of said shower pan's vertical walls and the bottom of the sheetrock enclosing said shower enclosure;

installing a weep line positioned between said shower pan floor and said shower floor to permit injection of mold inhibiting chemicals).

* * * * *